US008500417B2

(12) United States Patent
Han et al.

(10) Patent No.: US 8,500,417 B2
(45) Date of Patent: Aug. 6, 2013

(54) MOTORIZED VACUUM PUMP WITH SOUND ABSORBING UNIT

(75) Inventors: Donghee Han, Hwaseong-si (KR); Wootae Kim, Hwaseong-si (KR); Seungkook Han, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 260 days.

(21) Appl. No.: 12/873,948

(22) Filed: Sep. 1, 2010

(65) Prior Publication Data

US 2011/0129367 A1 Jun. 2, 2011

(30) Foreign Application Priority Data

Dec. 2, 2009 (KR) ..... 10-2009-0118665

(51) Int. Cl.
*F04C 29/06* (2006.01)

(52) U.S. Cl.
USPC ..... 417/312; 181/229

(58) Field of Classification Search
USPC ..... 417/312, 410.3; 181/222, 229, 252, 181/256; 310/87–89
See application file for complete search history.

(56) References Cited

U.S. PATENT DOCUMENTS

| | | | | |
|---|---|---|---|---|
| 4,123,201 | A * | 10/1978 | Andriulis | 417/204 |
| 4,728,266 | A * | 3/1988 | Matsumoto et al. | 417/366 |
| 5,401,150 | A * | 3/1995 | Brown | 418/181 |
| 6,183,215 | B1 | 2/2001 | Sakai et al. | |
| 6,376,949 | B1 * | 4/2002 | Hayslett | 310/88 |
| 6,491,505 | B1 * | 12/2002 | Hueser et al. | 417/410.3 |
| 6,790,019 | B1 * | 9/2004 | Hinchey, Jr. | 418/15 |
| 7,189,068 | B2 * | 3/2007 | Thomas et al. | 418/181 |
| 2005/0134129 | A1 * | 6/2005 | Sato et al. | 310/88 |
| 2010/0090551 | A1 * | 4/2010 | Burton | 310/88 |

FOREIGN PATENT DOCUMENTS

| | | | |
|---|---|---|---|
| JP | 61-116089 | A | 6/1986 |
| JP | 5-321898 | A | 12/1993 |
| JP | 7-332269 | A | 12/1995 |
| JP | 11-336665 | A | 12/1999 |
| JP | 2006-022794 | A | 1/2006 |
| KR | 10-2006-0037232 | A | 5/2006 |
| KR | 10-2007-0008329 | A | 1/2007 |

* cited by examiner

*Primary Examiner* — Devon Kramer
*Assistant Examiner* — Nathan Zollinger
(74) *Attorney, Agent, or Firm* — Morgan, Lewis & Bockius LLP

(57) ABSTRACT

A motorized vacuum pump apparatus, may include an electric motor operating in response to an electric signal, a pumping unit connected with a motor shaft of the electric motor, and a sound absorbing unit enclosing the pumping unit and having an inlet for sucking external air, a damping chamber and an outlet, wherein the sound absorbing unit is directly combined with the electric motor, and wherein the external air is compressed and supplied by the pumping unit to the damping chamber and discharged through the outlet such that noise is reduced by damping compressed air in the damping chamber.

12 Claims, 3 Drawing Sheets

MOTORIZED VACUUM PUMP WITH SOUND ABSORBING UNIT

CROSS-REFERENCE TO RELATED APPLICATIONS

The present application claims priority to Korean Patent Application Number 10-2009-0118665 filed Dec. 2, 2009, the entire contents of which application is incorporated herein for all purposes by this reference.

BACKGROUND OF THE INVENTION

1. Field of the Invention

The present invention relates to a motorized vacuum pump, in more detail, a motorized vacuum pump having an improved structure to have small weight and volume by simplifying the components.

2. Description of Related Art

Most gasoline engines and passenger diesel engines uses vacuum pressure for operating the brake, EGR (Exhaust Gas Recirculation), and turbo charger actuator.

The gasoline engines uses a vain type vacuum pump rotating with a rotary shaft of an alternator connected with a crankshaft by a pulley, for the characteristics, or uses a cam-driven vacuum pump in which a vacuum pump is connected with a camshaft to operate, and the passenger diesel engines having high air-use rate use a specific vacuum pump.

However, since hybrid vehicles that are increasingly interested in recent years do not have boosting pressure, a vacuum pump for generating brake boosting pressure is required.

The motorized vacuum pump is lack of vacuum as compared with a cam-driven vacuum pump or operates only when it needs, such that it can improve fuel efficiency by preventing loss of energy.

Motorized vacuum pumps generally used in the related art includes: an electric motor operating in response to an electric signal; a pumping unit connected with a motor shaft of the electric motor and compressing and discharging sucked air by pumping; a mounting plate unit disposed between the electric motor and the pumping unit and having an inlet and outlet for sucking external air; and a sound absorbing unit reducing noise by damping the air compressed by the pumping unit.

Further, a drainage for discharging water formed when the compressed air condenses to the outside is included.

The motorized vacuum pump of the related art has the disadvantage in that the number of parts is large, the structure is complicated, the volume is large, and assemble and disassembly are difficult.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a motorized vacuum pump having an improved structure to reduce the manufacturing cost by decreasing the number of parts, and reducing the volume and weight by simplifying the vacuum components.

In a aspect of the present invention, the motorized vacuum pump apparatus, may include an electric motor operating in response to an electric signal, a pumping unit connected with a motor shaft of the electric motor, and a sound absorbing unit enclosing the pumping unit and having an inlet for sucking external air, a damping chamber and an outlet, wherein the sound absorbing unit is directly combined with the electric motor, and wherein the external air is compressed and supplied by the pumping unit to the damping chamber and discharged through the outlet such that noise is reduced by damping compressed air in the damping chamber.

The sound-absorbing unit may have an inlet channel connected to the inlet, and the pumping unit may include an inlet slot formed in an upper plate and connected to the inlet channel such that the external air is supplied to a rotor coupled to motor shaft of the electric motor, through the inlet, the inlet channel and the inlet slot, wherein air compressed by the rotor is supplied to the damping chamber.

The damping chamber may be formed between the upper plate of the pumping unit and an upper surface of the sound-absorbing unit.

The electric motor may have a drainage formed downward and fluid-communicating with the damping chamber such that water condensed from the compressed air is discharged therethrough by gravity.

The sound absorbing unit may have a flange formed along an outer circular edge at a lower side thereof, and the flange of the sound absorbing unit overlaps a flange of the electric motor formed at upper side thereof and is detachably fastened thereto, wherein the drainage is formed through the flange of the electric motor.

According to the present invention, it is possible to reduce the weight and volume by improving the structure of a motorized vacuum pump. Therefore, it is possible reduce the weight, volume, and manufacturing cost by reducing the number of parts, and also utilize assembly and disassembly, by forming an inlet and an outlet in the sound absorbing unit and removing a mounting plate.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
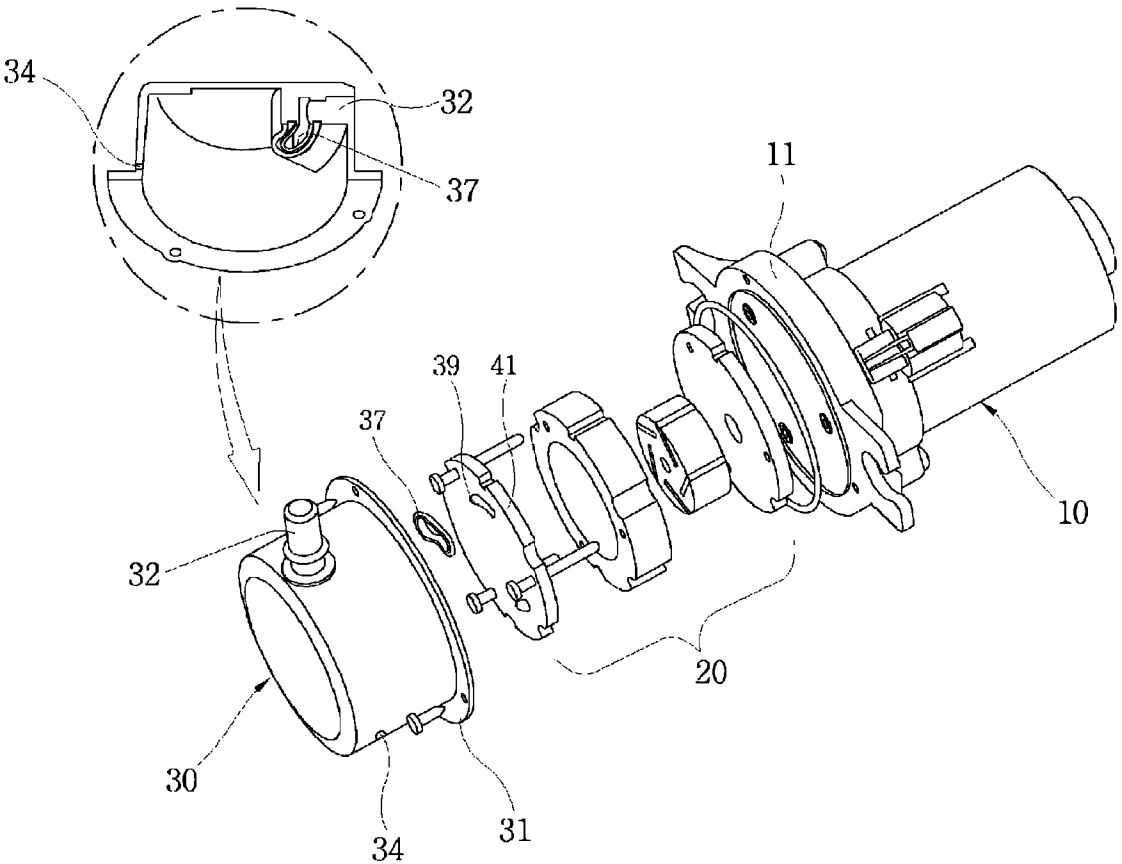
FIG. 1 is an exploded perspective view showing an exemplary motorized vacuum pump according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
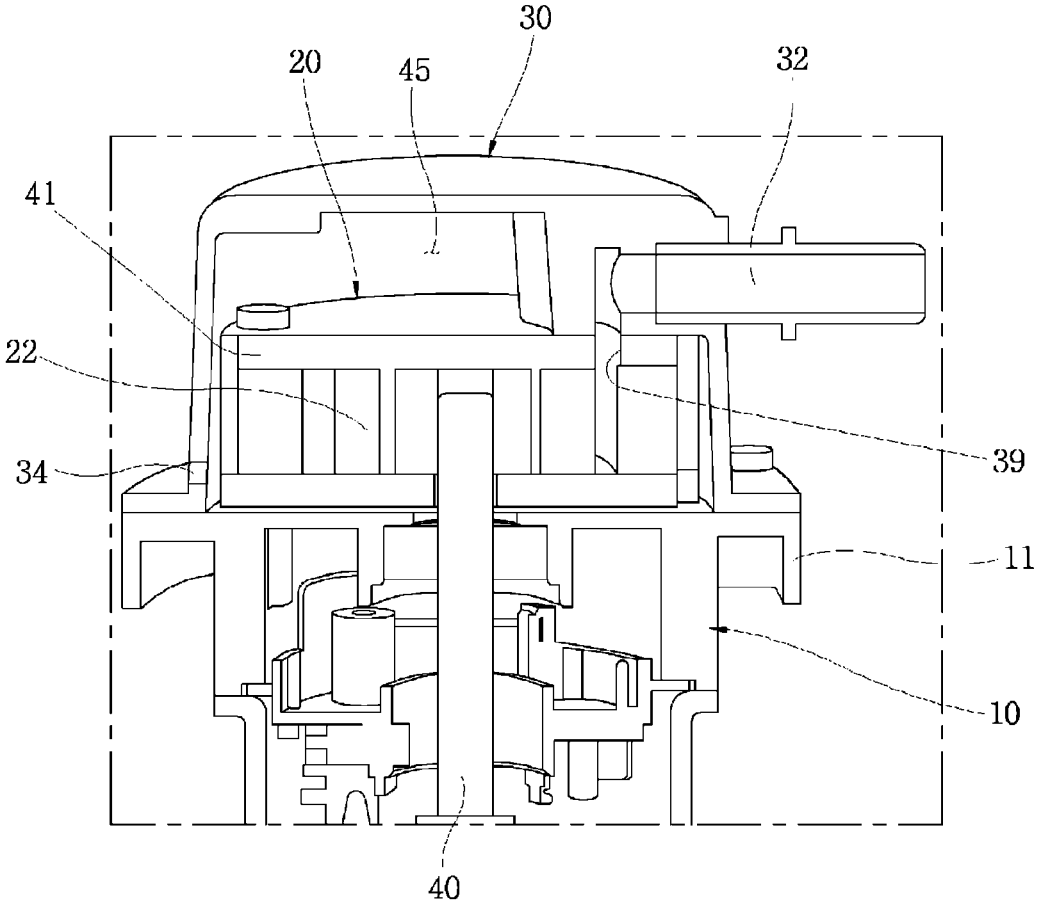
FIG. 2 is a cross-sectional view showing an assembly of an exemplary motorized vacuum pump according to the present invention.
Figure 3:
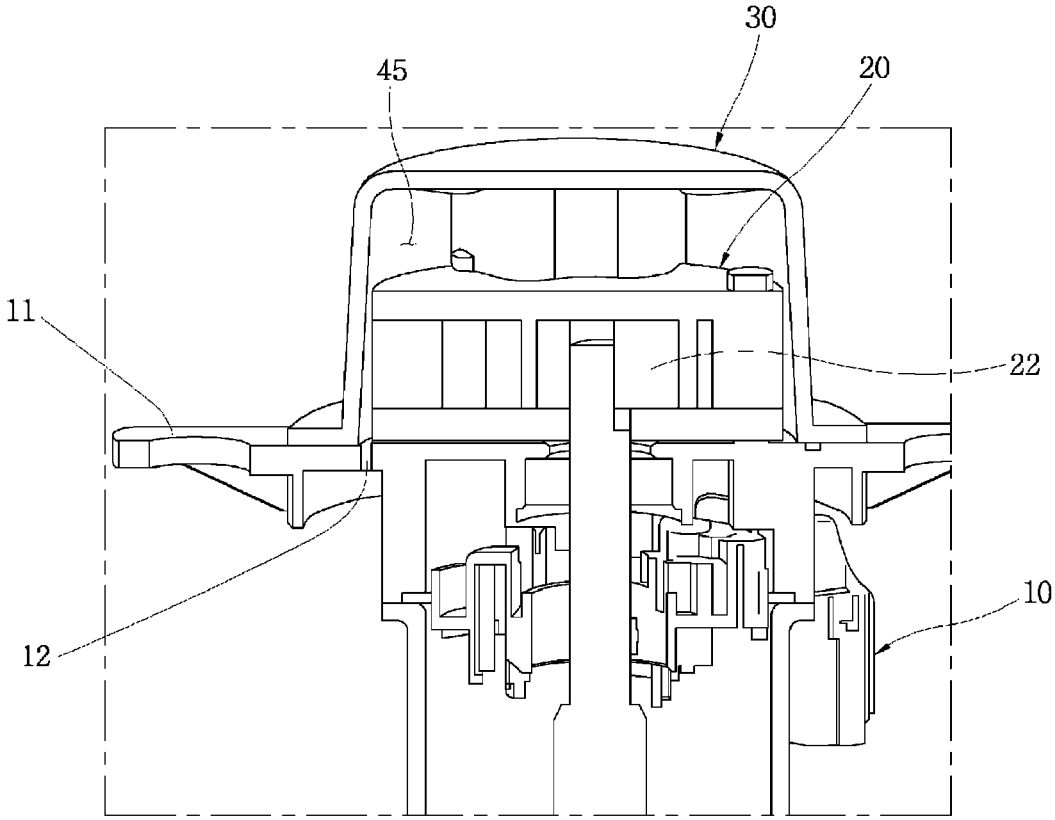
FIG. 3 is a cross-sectional view showing a drainage of an exemplary motorized vacuum pump according to the present invention.

Referring to FIGS. 1 to 3, a motorized vacuum pump according to an exemplary embodiment of the present invention includes an electric motor 10 operating in response to an external electric signal, a pumping unit 20 connected with a motor shaft 40 of electric motor 10 and compressing and discharging sucked air by pumping, and a sound absorbing unit 30 having an inlet 32 for sucking external air and an outlet 34 for discharging air compressed by pumping unit 20, on the outer circumference, and reducing noise by damping the compressed air.

Pumping unit 20 has a well-known structure including a rotor 22 connected with a motor shaft 40 to rotate.

Sound absorbing unit 30 is formed in a bowl shape by deep drawing and has a flange 31 formed along the circular edge at one side, flange 31 of sound absorbing unit 30 overlaps a flange 11 of electric motor 10 and fastened by a plurality of bolts.

Sound absorbing unit 30 has a damping chamber 45 therein to reduce noise by damping the compressed air.

In this configuration, inlet 32 of sound absorbing unit 30 is connected to an inlet channel 37. An inlet slot 39 is formed in an upper plate 41 of the pumping unit 20 such that the air sucked from the inlet 32 is supplied into the compression space formed in the rotor 22 through the inlet channel 37 and the inlet slot 39. Thereafter the compressed air is supplied from the compression space into the damping chamber 45 formed above the pumping unit 20.

Further, electric motor 10 has a drainage 12 formed through flange 11 downward from the damping chamber 45 where the gravity is exerted such that the water formed by condensation of the compressed air can be drained to the outside.

Drainage 12 has an additional function for discharging the compressed air, in addition to the function of discharging the water.

In the present invention, inlet 32 that is an air intake channel and outlet 34 that is a discharge channel of the vacuum pump are integrally formed in sound absorbing unit 30.

Further, the present invention has a structure in which sound absorbing unit 30 and housing of electric motor 10 are directly connected by removing the mounting plate disposed between pumping unit 20 and electric motor 10.

Therefore, electric motor 10 can be completely separated, which is advantageous in sealing the motor itself and also sealing the joint between electric motor 10 and pumping unit 20.

The operation of the present invention having this configuration is as follows.

In the motorized vacuum pump according to an exemplary embodiment of the present invention when an external electric signal is applied to electric motor 10, electric motor 10 operates to rotate rotor 22 of pumping unit 20 which is connected with the motor shaft.

As pumping unit 20 operates, the external air is sucked into pumping unit 20 through inlet 32 of sound absorbing unit 30 and compressed therein, and the compressed air is discharged to the outside through outlet 34 of sound absorbing unit 30.

In this configuration, the process of compressing air in pumping unit 20 is well known and the same as the existing processes and the detailed description is not provided.

The condensed water produced in the compression process of pumping unit 20 is discharged outside by gravity through the damping chamber and drainage 12.

Therefore, the present invention makes it possible to minimize adverse effects on the pump performance even when the water is condensed in pumping unit 20 by separating outlet 34 of the compressed air and water drainage 12.

Further, it is possible to discharge the compressed air to the outside through drainage 12.

Since inlet 32 is formed in sound absorbing unit 30, it is easy to ensure an intake channel for sucking the external air, thereby improving efficiency of the pump.

That is, according to the motorized vacuum pump of the present invention, it is possible to remove the mounting plate of motorized vacuum pumps of the related art, such that it is possible to decrease the weight by reducing the number of parts, and also decreases the volume, thereby increasing spatial usability.

Further, it is possible to save the manufacturing cost by reducing the number of parts and utilize assembly and disassembly.

For convenience in explanation and accurate definition in the appended claims, the terms "upper", "lower", "inner", and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A motorized vacuum pump apparatus, comprising:

an electric motor operating in response to an electric signal;

a pumping unit connected with a motor shaft of the electric motor; and a sound absorbing unit enclosing the pumping unit and having an inlet for sucking external air, a damping chamber and an outlet;

wherein the sound absorbing unit is directly combined with the electric motor;

wherein the external air is compressed and supplied by the pumping unit to the damping chamber and discharged outside the sound absorbing unit through the outlet such that noise is reduced by damping compressed air in the damping chamber;

wherein passages for the pumping unit are formed within the sound absorbing unit;

wherein the electric motor has a drainage formed downward such that water condensed from the compressed air is discharged therethrough by gravity; and wherein the drainage is formed along a direction of a center axis in the sound absorbing unit and the outlet is formed in a perpendicular direction to the drainage.

2. The motorized vacuum pump apparatus as defined in claim 1, wherein the sound-absorbing unit has an inlet channel connected to the inlet, and the pumping unit includes an inlet slot formed in an upper plate and connected to the inlet channel such that the external air is supplied to a rotor coupled to the motor shaft of the electric motor, through the inlet, the inlet channel and the inlet slot.

3. The motorized vacuum pump apparatus as defined in claim 2, wherein air compressed by the rotor is supplied to the damping chamber.

4. The motorized vacuum pump apparatus as defined in claim 2, wherein the damping chamber is formed between the upper plate of the pumping unit and an upper surface of the sound-absorbing unit.

5. The motorized vacuum pump apparatus as defined in claim 1, wherein the sound absorbing unit has a flange formed along an outer circular edge at a lower side thereof, and the flange of the sound absorbing unit overlaps a flange of the electric motor formed at an upper side thereof and is detachably fastened thereto.

6. The motorized vacuum pump apparatus as defined in claim 5, wherein the drainage is formed through the flange of the electric motor.

7. A motorized vacuum pump apparatus, comprising:

an electric motor operating in response to an electric signal;

a pumping unit connected with a motor shaft of the electric motor; and a sound absorbing unit having an inlet for sucking external air therethrough and an outlet for discharging outside the sound absorbing unit air compressed by the pumping unit which is combined with the electric motor while covering the pumping unit to reduce noise by damping compressed air;

wherein passages for the pumping unit are formed integrally within the sound absorbing unit;

wherein the electric motor has a drainage formed downward such that water condensed from the compressed air is discharged therethrough by gravity; and wherein the drainage is formed along a direction of a center axis in the sound absorbing unit and the outlet is formed in a perpendicular direction to the drainage.

8. The motorized vacuum pump apparatus as defined in claim 7, wherein the sound absorbing unit is formed in a bowl shape and has a flange formed along an outer circular edge at one side thereof, and the flange of the sound absorbing unit overlaps a flange of the electric motor and is separably fastened thereto.

9. The motorized vacuum pump apparatus as defined in claim 8, wherein the drainage is formed through the flange of the electric motor and the drainage fluid-communicates with an inner space of the sound absorbing unit.

10. A motorized vacuum pump apparatus, comprising:

an electric motor operating in response to an electric signal;

a pumping unit connected with a motor shaft of the electric motor; and a sound absorbing unit combined with the electric motor while covering the pumping unit, reducing noise by damping compressed air, and having an inlet for sucking external air and guiding the external air into the pumping unit with a passage and an outlet for discharging the compressed air outside the sound absorbing unit;

wherein passages for the pumping unit are formed integrally within the sound absorbing unit;

wherein the electric motor has a drainage formed downward such that water condensed from the compressed air is discharged therethrough by gravity; and wherein the drainage is formed along a direction of a center axis in the sound absorbing unit and the outlet is formed in a perpendicular direction to the drainage.

11. The motorized vacuum pump apparatus as defined in claim 10, wherein the sound absorbing unit is formed in a bowl shape and has a flange formed along an outer circular edge at one side thereof, and the flange of the sound absorbing unit overlaps a flange of the electric motor and is separably fastened thereto.

12. The motorized vacuum pump apparatus as defined in claim 11, wherein the drainage is formed through the flange of the electric motor and the drainage fluid-communicates with an inner space of the sound absorbing unit.

* * * * *